United States Patent [19]

Yoshino

[11] Patent Number: 4,698,079

[45] Date of Patent: Oct. 6, 1987

[54] HIGH-PURITY NITROGEN GAS PRODUCTION EQUIPMENT

[75] Inventor: Akira Yoshino, Osaka, Japan

[73] Assignee: Daidousanso Co., Ltd., Osaka, Japan

[21] Appl. No.: 845,277

[22] PCT Filed: Jul. 8, 1985

[86] PCT No.: PCT/JP85/00386

§ 371 Date: Mar. 12, 1986

§ 102(e) Date: Mar. 12, 1986

[87] PCT Pub. No.: WO86/00694

PCT Pub. Date: Jan. 30, 1986

[30] Foreign Application Priority Data

Jul. 13, 1984 [JP] Japan ..... 59-146332

[51] Int. Cl.[4] ..... F25J 3/00

[52] U.S. Cl. ..... 62/11; 62/32; 62/36; 62/40; 62/42

[58] Field of Search ..... 62/9, 11, 32, 33, 34, 62/36, 40, 42

[56] References Cited

U.S. PATENT DOCUMENTS

| | | | |
|---|---|---|---|
| 2,940,269 | 6/1960 | Frainier | 62/11 |
| 3,062,016 | 11/1962 | Dennis et al. | 62/33 |
| 3,363,427 | 1/1968 | Blanchard et al. | 62/40 |
| 3,645,106 | 2/1972 | Gaumer, Jr. et al. | 62/9 |
| 4,526,425 | 7/1985 | McNeil | 62/39 |
| 4,526,595 | 7/1985 | McNeil | 62/39 |

FOREIGN PATENT DOCUMENTS 1463075 2/1977 United Kingdom .

*Primary Examiner*—Ronald C. Capossela
*Attorney, Agent, or Firm*—Armstrong, Nikaido, Marmelstein & Kubovcik

[57] ABSTRACT

There is disclosed a high-purity nitrogen gas production equipment for production of ultra-high-purity nitrogen gas for use in the electronics and other industries, for example in connection with the production of silicon semiconductors. The conventional nitrogen gas production equipment of cryogenic air separation type tends to develop troubles and yields product nitrogen gas only at high cost and in comparatively low purity. The equipment according to the invention is such that a liquid nitrogen storage means (23) is connected via a feeding pipeline (24*a*) to a column segment (22) of a distillation column (15) which consists of a partial condenser segment (21) having a built-in condenser (21*a*) and the intermediate-pressure column segment (22) and the cryogenic compressed air supplied into the intermediate-pressure column segment (22) of the distillation column (15) via an air compression means (9) and heat exchange means (13), (14) is further chilled by the liquid nitrogen reflux liquid obtained in said partial condenser segment (21) and the heat of evaporation of the liquid nitrogen supplied from the liquid nitrogen storage means (23). By taking advantage of the difference in boiling point, the nitrogen is withdrawn as an intermediate-pressure gas from a top portion of the column segment (22) while oxygen is retained in liquid state. The resulting intermediate-pressure nitrogen gas is used as product nitrogen gas. By these features, low-cost, high-purity nitrogen gas can be produced without an energy loss due to pressure loss and without machine troubles.

3 Claims, 3 Drawing Figures

HIGH-PURITY NITROGEN GAS PRODUCTION EQUIPMENT

TECHNICAL FIELD

The present invention relates to a production equipment for high-purity nitrogen gas.

BACKGROUND ART

While the electronics industry consumes a very large quantity of nitrogen gas, stringent requirements have been imposed on the purity of the nitrogen gas they use from the standpoint of maintenance of the high precision of parts. Nitrogen gas is generally produced from air in a production sequence which consists of compressing the air with a compressor, passing the compressed air through an adsorbent column to remove carbon dioxide gas and water, feeding the emerging air further to a heat exchanger where it is chilled by heat exchange with a refrigerant, feeding the chilled air to a distillation column for cryogenic liquefaction and separation to give product nitrogen gas, and finally passing the same through said heat exchanger to heat it up to a temperature near atmospheric temperature. However, the product nitrogen gas thus produced contains oxygen as an impurity and the use of this nitrogen gas as it is presents various prcblems. One of the methods for removing impurity oxygen (1) comprises adding a small amount of hydrogen to nitrogen gas and reacting the hydrogen in the mixture with the impurity oxygen in the nitrogen gas in the presence of a platinum catalyst at a temperature of about 200° C. to remove the impurity oxygen in the form of water. Another method (2) comprises contacting nitrogen gas with a nickel catalyst at a temperature of about 200° C. to remove the impurity oxygen by way of the reaction $Ni + \frac{1}{2}O_2 \rightarrow NiO$. However, as both methods involve the step of heating nitrogen gas to a high temperature for catalytic reaction, the corresponding hardware cannot be built into the nitrogen gas production line which is a cryogenic system. That is to say, the purification equipment must be installed independently of the nitrogen gas production equipment and this entails, of necessity, the disadvantage that the overall size of the production plant is increased. Furthermore, the first-mentioned method (1) requires exact control over the addition level of hydrogen. Unless hydrogen is added in an amount exactly commensurate with the amount of impurity oxygen present, either some oxygen remains in the product gas or the very hydrogen so added becomes a new impurity, so that high skill is required in operation. In the second-mentioned method (2), the NiO produced in the reaction with impurity oxygen must be regenerated ($NiO + H_2 \rightarrow Ni + H_2O$) and the cost of the $H_2$ gas equipment for catalyst regeneration contributes to an increased purification cost. Solutions to these problems have been awaited.

Furthermore, the conventional nitrogen gas production equipment employs an expansion turbine for chilling the refrigerant used for heat exchange with compressed air from the compressor and this turbine is driven by the pressure of the gas generated by gasification of the liquid air collecting in the distillation column (as the result of cryogenic liquefaction and separation, the low-boiling nitrogen leaves the column, while the balance in the form of an oxygen-rich liquid air collects in the column). However, the expansion turbine has a high rotational speed (in the order of tens of thausands of revolutions per minute) and cannot easily follow a variation in load, thus requiring a specially trained operator. Moreover, as a high-speed machine, the expansion turbine not only demands high-precision in construction and is costly but requires specially trained personnel for its operation. These problems emanate all from the high-speed rotary mechanism of the expansion turbine and there has been a strong demand for elimination of the expansion turbine having such a high-speed rotary mechanism.

OBJECT OF THE INVENTION

It is an object of the present invention to provide a high-purity nitrogen gas production equipment which requires neither an expansion turbine nor a purification system.

DISCLOSURE OF THE INVENTION

Developed for the purpose of accomplishing the above-mentioned object, the present invention comprises an air compression means for compressing the air from an external environment, an elimination means for eliminating carbon dioxide gas and water from the compressed air; a heat exchange means for chilling the compressed air from said elimination means to a cryogenic temperature, a distillation column adapted to liquefy a portior of the cryogenic compressed air from said heat exchange means and collect the same therein while retaining nitrogen alone in gaseous form, a liquid nitrogen storage means for storing liquid nitrogen, a feeding pipeline for leading liquid nitrogen in said liquid nitrogen storage means to said distillation column for use as a refrigerant, and a nitrogen gas withdrawal line for withdrawing the retained gaseous nitrogen from said distillation column, said distillation column consisting of a partial condenser segment having a built-in condenser for production of reflux liquid and a column segment for liquefaction and separation of compressed air, said partial condenser segment communicating with the bottom of said column segment via a liquid air intake pipeline equipped with an expansion valve and the inlet and outlet of said built-in condenser in said partial condenser segment communicating with the top of said column segment via a first and a second reflux pipeline, respectively, and said column segment being connected at its bottom to said heat exchange means and at its top to said feeding pipeline and nitrogen gas withdrawal line.

EFFECTS OF THE INVENTION

The high-purity nitrogen gas production equipment according to the present invention does not employ an expansion turbine but, instead, employs a liquid nitrogen storage means such as a liquid nitrogen storage tank having no rotary element and, therefore, the whole equipment has no revolving parts and, hence, is trouble-free. Furthermore, whereas the expansion turbine is costly, the liquid nitrogen tank is not expensive and does not require special personnel for operation. In addition, the expansion turbine (which is driven by the pressure of the gas generated from the liquefied air collected within the nitrogen distillation column) is driven at a very high speed (the order of several times a thousand revolutions per minute), it is difficult to follow a delicate variation in load (the variation in the rate of withdrawal of product nitrogen gas). Therefore, it is difficult to accurately vary the supply of liquefied air to the expansion turbine according to the change in the outgoing product nitrogen gas so as to chill the compressed air, which is the raw material for nitrogen gas, to a constant temperature at all times. As a consequence, the product nitrogen gas varies in purity so that low-purity products may be withdrawn from time to time to affect the overall quality of production.

In contrast, as the equipment according to the present invention employs a liquid nitrogen storage tank, in lieu of the expansion turbine, and liquid nitrogen, which permits delicate control of feed, as a refrigerant, the equipment allows for delicate followup of load variation and, thus, enables one to produce nitrogen gas of extremely high and uniform purity. This, in turn, erables one to dispense with the purification system heretofore required. Furthermore, the equipment according to the present invention comprises a partial condenser segment having a built-in condenser for production of reflux liquid and a column segment for liquefaction and separation of compressed air, and the column segment is supplied with the compressed air prepared by an air compression means substantially without a pressure loss. As a result, product nitrogen gas is produced substantially without a loss of energy and, hence, the cost of product nitrogen gas is reduced. In addition, as the pressure of the product nitrogen gas is high, a larger quantity of gas can be transported with pipelines of a given diameter and assuming that the transport quantity is kept constant, pipes of smaller diameter can be employed so as to effect economies in the initial cost of the equipment.

BEST MODE FOR CARRYING OUT THE INVENTION

Figure 1:
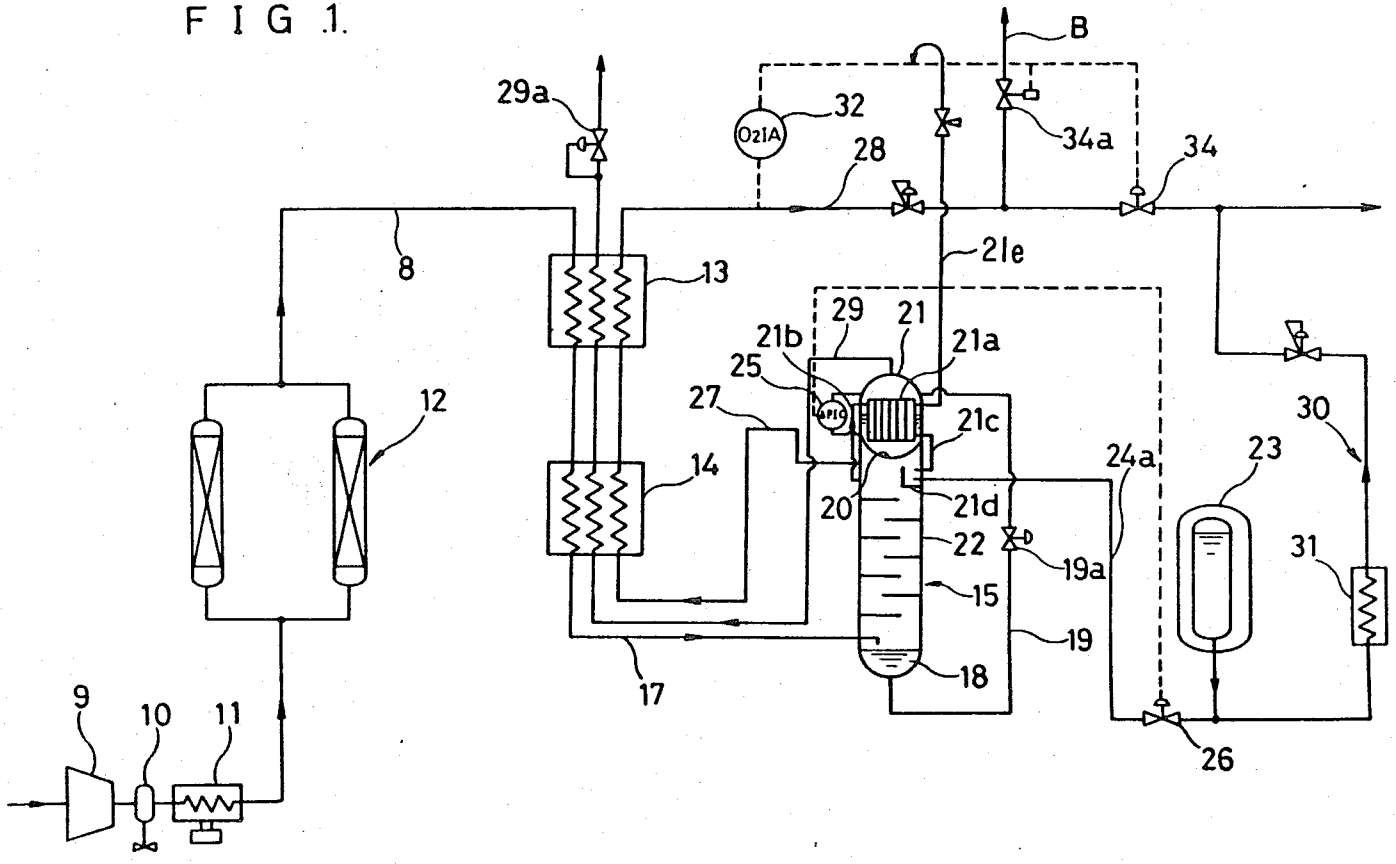
FIG. 1 is a schematic process diagram showing one embodiment of the present invention.

The present invention will be described in detail with reference to its embodiments FIG. 1 shows an embodiment of the present invention. In FIG. 1, the reference numeral 9 indicates an air compressor, 10 a drain separator, 11 a Freon refrigerator, and 12 a couple of adsorbent columns. Each adsorbent column is packed with a molecular sieve which adsorbs and remove $H_2O$ and $CO_2$ from the compressed air from said air compressor 9. Indicated at 8 is a compressed air pipeline for feeding the compressed air freed of $H_2O$ and $CO_2$ by adsorption. The numeral 13 indicates a first heat exchanger which is supplied with the compressed air freed of $H_2O$ and $CO_2$ in the adsorbent column couple 12. To a second heat exchanger 14 is fed the compressed air from the first heat exchanger 13. The numeral 15 indicates a distillation column, the top portion of which constitutes a partial condenser segment 21 having a condenser 21*a*, with the underneath portion constituting a column segment 22. In the distillation column, the compressed air chilled to a cryogenic temperature in the first and second heat exchangers 13, 14 and fed via the pipeline 17 is further chilled and a portion thereof is liquefied and collects in the bottom of the column segment 22 as liquefied air 18 while nitrogen alone is pooled in gaseous state in the top ceiling portion of the column segment 22. A liquid nitrogen storage tank 23 contains liquid nitrogen (high-purity product) which is fed via a feeding pipeline 24*a* into the top of the column segment 22 of the distillation column 15 for use as a refrigerant for the compressed air introduced into the column segment 22. The above-mentioned distillation column 15 is now described in detail. The distillation column 15 is divided by a partitioning plate 20 into the partial condenser segment 21 and the column segment 22, and the condenser 21*a* in the partial condenser segment 21 is supplied with a portion of the nitrogen gas collected in the top portion of the column segment 22 via a pipeline 21*b*. The inside of this partial condenser segment 21 is relatively decompressed with respect to the inside of the column segment 22, and the liquefied air ($N_2$, 50–70%; $O_2$, 30–50%) pooled in the bottom of the column segment 22 is fed via a pipeline 19 equipped with an expansion valve 19*a* and gasified therein to lower the internal temperature to a level below the boiling point of liquid nitrogen. As a result of this chilling, the nitrogen gas fed into the condenser 21*a* is liquefied. The numeral 25 indicates a evel gauge. According to the level of liquefied air in the partial condenser segment 21, a valve 26 is controlled to adjust the supply of nitrogen gas from a liquid nitrogen storage tank 23. The top portion of the column segment 22 of the distillation column 15 is supplied with the liquid nitrogen produced in the condenser 21*a* of said partial condenser segment 21 via a down-coming pipeline 21*c* and also with liquid nitrogen from the liquid nitrogen storage tank 23 via the pipeline 24*a*. These two streams of liquid nitrogen flow down the column segment 22 from a liquid nitrogen basin 21*d* and come in counter-current contact with, and cool, the compressed air ascending from the bottom of the column segment 22 to thereby liquefy part of the compressed air. In this process, the high-boiling components in the compressed air are liquefied and collect in the bottom of the column segment 22, while nitrogen gas which is a low-boiling component collects in the top portion of the column segment 22. The reference numeral 27 indicates a withdrawal pipeline for withdrawing the nitrogen gas cooled in the top ceiling portion of the column segment 22 of the distillation column as product nitrogen gas. This pipeline guides the cryogenic nitrogen gas to the second and first exchangers 14, 13 for heat exchange with the compressed air fed thereto, and leads it at atmospheric temperature to a main pipeline 28. In this connection, since low-boiling He (−269° C.) and $H_2$ (−253° C.) tend to collect, together with nitrogen gas, in the uppermost portion of the column segment 22 of the distillation column, the withdrawal pipeline 27 is disposed to communicate at a substantial distance below the uppermost portion of the column segment 22 so that pure nitrogen gas free from He and H2 may be withdrawn as product nitrogen gas. The reference numeral 29 indicates a pipeline for feeding gasified liquid air in the partial condenser segment 21 to the second and first heat exchangers 14, 13, with a pressure control valve thereof being indicated at 29*a*. The numeral 30 indicates a backup system line which, in the event of a failure of the air compression line, evaporates the liquid nitrogen in the liquid nitrogen storage tank 23 by means of an evaporator 31 and feeds it to the main pipeline 28 so as to prevent interruption of nitrogen gas supply. Indicated at 32 is an impurity analyzer which analyzes the purity of product nitrogen gas going out into the main pipeline 28 and, when the purity is low, actuates valves 34 and 34*a* to let off the product nitrogen gas in the direction indicated by the arrowmark B. Further, blowoff conduit 21e blows off gasified liquid air produced in the partial condenser segment to the outside.

The equipment described above produces product nitrogen gas in the following manner. Thus, the air compressor 9 compresses the material air and the drain separator 10 removes water from the compressed air. The freon refrigerator 11 chills the compressed air and the chilled air is fed to the adsorption columns 12, where $H_2O$ and $CO_2$ in the air are adsorbed and removed. This compressed air freed of $H_2O$ and $CO_2$ is fed to the first and second heat exchangers 13, 14 which have been cooled by the product nitrogen gas, etc. supplied from the distillation column 15 via the pipeline 27, where it is chilled to a cryogenic temperature. The chilled air is then directly charged into a lower portion of the column segment 22 of the distillation column. This charged compressed air is chilled by contact with the liquid nitrogen fed into the column segment 22 from the liquid nitrogen storage tank 23 via the feeding pipeline 24a and the liquid nitrogen overflowing the liquid nitrogen basin 21d, whereby a portion of the air is liquefied and collects as liquid air 18 in the bottom of the column segment 22. In this process, due to the difference between nitrogen and oxygen in boiling point (boiling point of oxygen −183° C.; boiling point of nitrogen −196° C.), oxygen which is a high-boiling fraction in the compressed air is liquefied while nitrogen remains as a gas. Then, this remaining gaseous nitrogen is withdrawn through the withdrawal pipeline 27 and fed to the second and first heat exchangers 14, 13, where it is heated to a temperature near atmospheric temperature. This nitrogen is withdrawn from the main pipe 28 as product nitrogen gas. In this connection, as the inside of the column segment 22 of the distillation column is held at a high pressure owing to the compressive force of the air compressor 9 and the vapor pressure of liquid nitrogen, the pressure of product nitrogen gas taken out from the withdrawal pipeline 27 is also high. This is advantageous when the product nitrogen gas is used as a purge gas. Moreover, because of this high pressure, a larger quantity of gas can be transported with pipelines of a given diameter and assuming that the amount of transportation is constant, pipes of smaller diameter can be utilized so that the equipment cost may be decreased. On the other hand, the liquefied air 18 collected in the lower part of the column segment 22 of the distillation column is fed into the partial condensor segment 21 where it is used to cool the condenser 21a. By this cooling, the nitrogen gas fed into the condenser 21a from the top portion of the column segment 22 of the distillation column is liquefied to form a reflux within the column segment 22 and recycled to the column segment 22 via the pipeline 21c. And the liquefied air 18 which has cooled the condensor 21a is gasified and flows to the secord and first heat exchangers 14, 13 via the pipeline 29 to chill the heat exchangers 14, 3, after which it is exhausted into the atmosphere. The liquid nitrogen fed from the liquid nitrogen storage tank 23 into the column segment 22 of the distillation column via the feeding pipeline 24a functions as a refrigerant for the liquefaction of compressed air and is gasified and withdrawn from the withdrawal pipeline 27 as part of product nitrogen gas. In this manner, the liquid nitrogen in the liquid nitrogen storage tank 23, after discharging its function as a refrigerant for liquefaction of compressed air, is not discarded but is combined with the high-purity nitrogen gas made from compressed air as product nitrogen, so that wasteless utilization can be realized.

Figure 2:
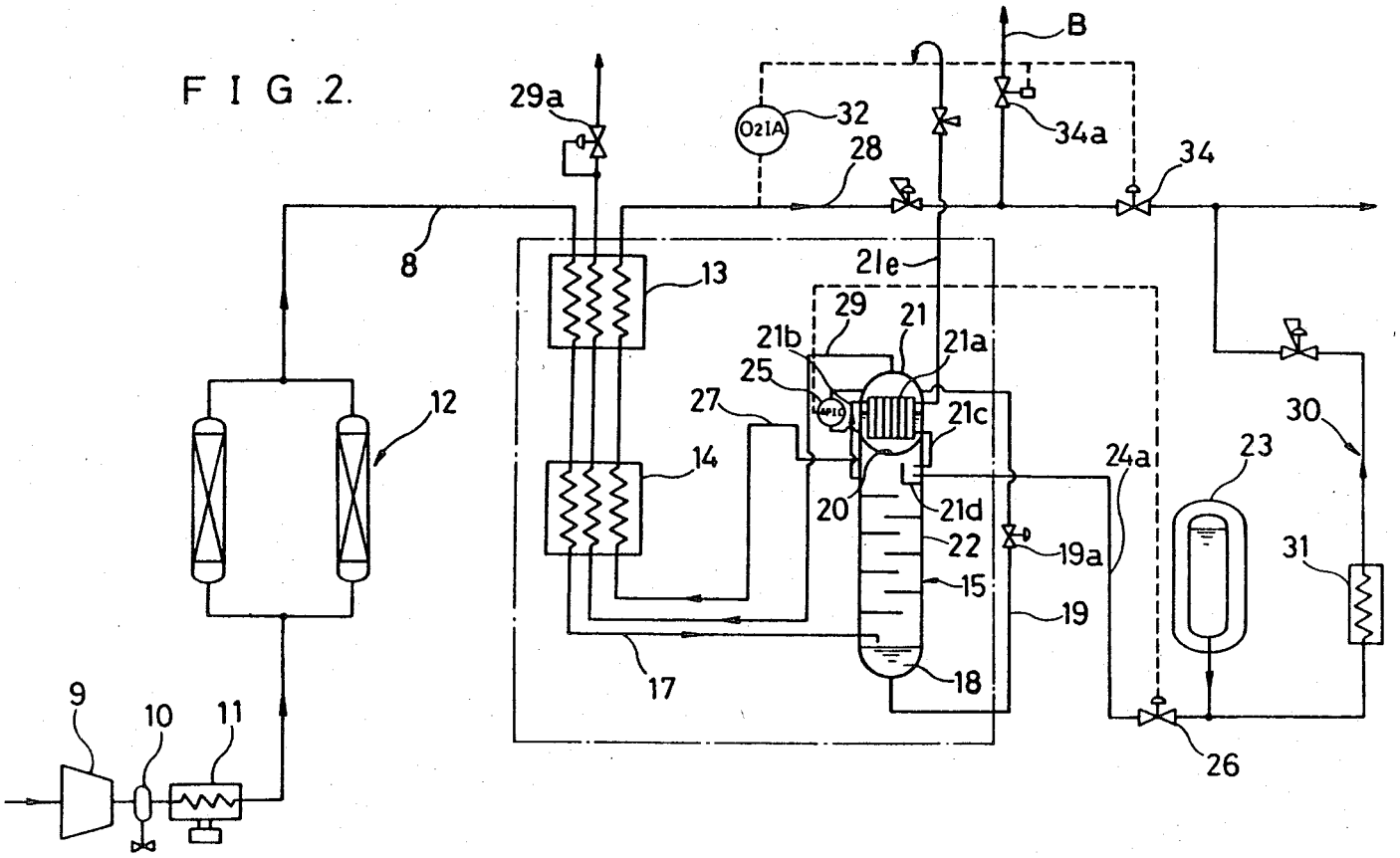
FIG. 2 is a schematic process diagram showing a modification thereof.

In FIG. 2 is shown an embodiment wherein a vacuum cold housing is additionally provided in the equipment of FIG. 1. Thus, in this embodiment, the distillation column 15 and the first and second heat exchangers 13, 14 are accommodated in a vacuum cold housing (indicated in dot-dash line) for enhancement of distillation efficiency. Otherwise, this equipment is identical with the equipment illustrated in FIG. 1.

Figure 3:
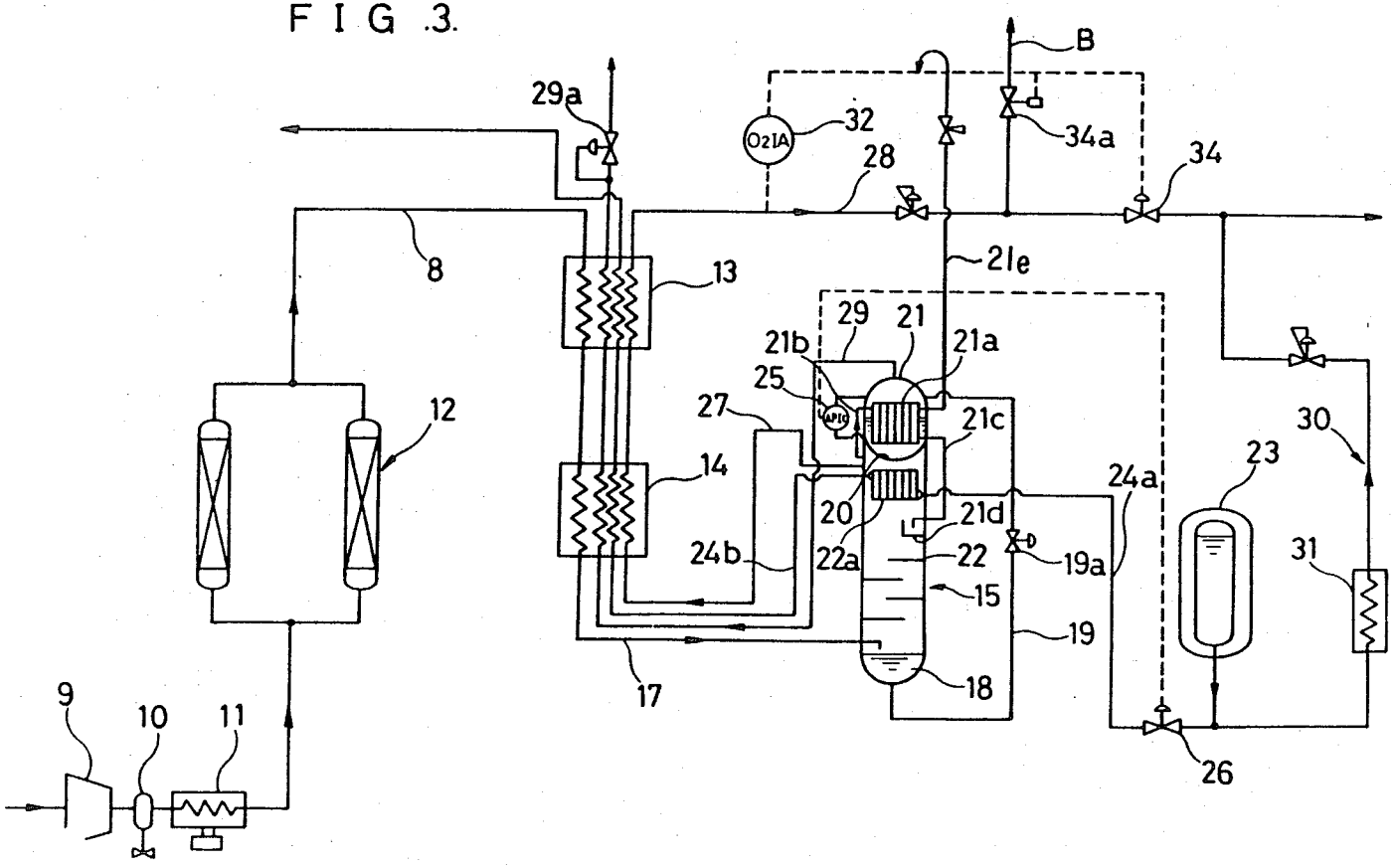
FIG. 3 is a schematic process diagram showing still another embodiment.

FIG. 3 shows an embodiment wherein a condenser is provided within the column segment of the nitrogen distillation column of the equipment shown in FIG. 1. Thus, in this equipment, a condenser 22a is provided within the column segment 22 of the nitrogen distillation column 15 and the liquid nitrogen in the liquid nitrogen storage tank 23 is fed as a refrigerant via the feeding pipeline 24a to the above condenser to chill the compressed air supplied from the lower portion of the column segment 22 and ascending up the column segment 22 to thereby liquefy high-boiling fractions such as oxygen and collect them in the bottom of the column segment 22, while nitrogen gas which is low-boiling collects in the top portion of the column segment 22. And the gasified liquid nitrogen after functioning as a refrigerant in the condenser 22a is guided to the withdrawal pipeline 24b, subjected to heat exchange in the second and first heat exchangers 14, 13, and discharged from the system. Otherwise, this equipment is identical with the equipment of FIG. 1.

I claim:

1. An apparatus for producing highly pure nitrogen gas comprising a means to compress the air taken from the outside, a means to remove carbon dioxide gas and water from the compressed air from said air compression means, a heat exchange means to chill the compressed air from said removing means to a cryogenic temperature, a rectification column to liquify a portion of the cryogenic compressed air from said heat exchange means and collect it in the lower region of the column while taking out pure nitrogen gas from the tip portion, wherein the apparatus further comprises a partial condenser segment having a condenser therin at the upper end of the rectification column, a feeding conduit to lead an accumlating liquified air in the lower region of the rectification column into the partial condenser segment for use as a refrigerant to cool said condenser, a blowoff conduit to blow off gasified liquid air produced in the partial condenser segment to the outside, a first relux liquid conduit to lead part of the nitrogen gas produced in the rectification column into said condenser, a second reflux liquid conduit to return the liquified nitrogen produced in the condenser to the rectification column as a reflux, a liquid nitrogen storage means to store liquid nitrogen supplied from outside the apparatus, a leading channel to lead the lquid nitrogen in the liquid nitrogen storage means to the column, a means to control the level of the liquid air in the condenser by controlling the supply of liquid nitrogen from the nitrogen storage means to the column, and an outlet channel to take out both the nitrogen gas from the rectification column and the gasified nitrogen in the recitification column after use as a cooling source, and to pass them through said heat exchanger and heat them by exchanging heat with the compressed air.

2. The nitrogen gas production equipment of claim 1, wherein the distillation column and the heat exchange means are disposed within a vacuum cold housing.

3. The nitrogen gas production equipment of claim 1, wherein a second condenser is disposed within the column segment to receive liquid nitrogen from the liquid nitrogen storage means so as to chill compressed air from the lower portion of the column segment.

* * * * *

UNITED STATES PATENT AND TRADEMARK OFFICE

CERTIFICATE OF CORRECTION

PATENT NO. : 4,698,079

DATED : October 6, 1987

INVENTOR(S) : Akira YOSHINO

It is certified that error appears in the above-identified patent and that said Letters Patent is hereby corrected as shown below:

Column 2, line 28, "portior" should read --portion--.

Column 3, line 14, "erables" should read --enables--;
line 44, "embodiments" should read --embodiments.--;
line 50, "remove" should read --removes--.

Column 4, line 21, "evel" should read --level--;
line 24, "nitrogen gas" should read --liquid nitrogen--;
line 54, "H2" should read --$H_2$--.

Column 5, line 55, "14, 3" should read --14, 13--.

Column 6, line 37, "tip" should read --top--;
line 40, "accumlating" should read --accumulating--.

Signed and Sealed this

Twentieth Day of September, 1988

*Attest:*

*Attesting Officer*

DONALD J. QUIGG

*Commissioner of Patents and Trademarks*